United States Patent [19]

Patel et al.

[11] Patent Number: 4,950,129

[45] Date of Patent: Aug. 21, 1990

[54] VARIABLE INLET GUIDE VANES FOR AN AXIAL FLOW COMPRESSOR

[75] Inventors: Manubhai M. Patel, Clifton Park; Robert F. Hoeft, Schenectady, both of N.Y.

[73] Assignee: General Electric Company, Schenectady, N.Y.

[21] Appl. No.: 312,264

[22] Filed: Feb. 21, 1989

[51] Int. Cl.[5] ..... F01D 19/00

[52] U.S. Cl. ..... 415/160; 415/148

[58] Field of Search ..... 415/148, 151, 160, 161

[56] References Cited

U.S. PATENT DOCUMENTS

| | | | |
|---|---|---|---|
| 2,985,427 | 5/1961 | Houghton | 415/164 |
| 3,101,926 | 8/1963 | Weber | 415/164 |
| 3,455,331 | 7/1969 | Baumann et al. | 415/163 |
| 3,887,297 | 6/1975 | Welchek | 415/161 |
| 4,770,605 | 9/1988 | Nakatomi | 415/148 |

FOREIGN PATENT DOCUMENTS

| | | | |
|---|---|---|---|
| 25275 | 8/1906 | Fed. Rep. of Germany | 415/161 |
| 1257377 | 2/1961 | France | 415/164 |
| 805015 | 11/1958 | United Kingdom | 415/161 |

*Primary Examiner*—Robert E. Garrett
*Assistant Examiner*—John T. Kwon
*Attorney, Agent, or Firm*—Nixon & Vanderhye

[57] ABSTRACT

An improvement in the inner tip support of variable inlet guide vanes in an axial flow compressor. Each of the guide vanes is rotatably mounted on a spindle at its radially outer end so that it can pivot between an open and a closed position. The improvement comprises a bushing disposed in the casing radially inward of each of said guide vanes, and a button on the end of each of said guide vanes contained within and forming clearances with the bushing walls, the button being eccentrically offset with respect to the guide vane spindle by a preselected amount and in a preselected direction to cause the button to provide restraining force on the vane inner ends when the vanes are in an open position.

15 Claims, 2 Drawing Sheets

VARIABLE INLET GUIDE VANES FOR AN AXIAL FLOW COMPRESSOR

BACKGROUND OF THE INVENTION

This invention relates generally to improvements to variable inlet guide vanes in axial flow compressors of the type used in industrial gas turbines. More particularly, the invention relates to improved constructions for reducing or suppressing vibratory response in variable inlet guide vanes which are caused by aerodynamic forces on the vanes at different rotated positions, particularly when the vanes are in the open position.

Axial flow compressors used in industrial gas turbines, often employ stationary radial vanes which may be rotated in unison to vary the angles of the vanes with respect to the fluid flowing through an annular passage in the frame of the compressor. The vanes are often rotatably mounted on radial spindles which support the outer part of the vanes. However, the inner tips of the vanes are subject to deflection and vibratory response, which varies with the turbulent conditions of fluid flow and with the position of the vanes.

One approach in the prior art to suppressing vibratory response in variable inlet guide vanes of axial flow compressors has been to limit the vane tip motion. A known partial solution to this problem is by means of a cylindrical radially projecting button at the vane's inner diameter that fits within a bushing supported in the stator frame. By limiting clearance between vane button and bushing, tip motion is limited. Vibration amplitude is controlled by selecting the clearance of the button within the bushing. However, some clearance must be provided to allow the vane to rotate through its closed-to-open position without binding.

When the vanes are in the closed position, i.e. providing maximum turning of the inlet air flow, the aerodynamic forces of the fluid on the vane are relatively great and deflect the vane so that the button contacts the bushing wall and suppresses vibration. However, when the inlet guide vanes are in the open position, with minimum turning of the inlet air, the aerodynamic forces on the vane are much smaller and the button is sometimes free to vibrate within the clearance of the bushing. This can lead to fatigue failure of the vane.

Accordingly, one object of the present invention is to provide an improved construction for suppressing vibratory response of variable inlet guide vanes in axial flow compressors.

Another object of the invention is to provide an improved construction for variable inlet guide vanes which reduces vibratory response in the open position when aerodynamic forces are at a minimum.

DRAWINGS

The invention, both as to organization and method of practice, together with further objects and advantages thereof, will best be understood by reference to the following description taken in connection with the accompanying drawings, in which:

FIG. 1 is an elevation view of a variable inlet guide vane and associated frame mounting in cross-section of an axial flow air compressor as known in the prior art, FIG. 2 is an elevational view of the same guide vane incorporating the improvement of the present invention, and FIGS. 3, 4, and 5 schematic plan views, not to scale, taken along lines A—A of FIG. 2 illustrating the operation of the present invention. FIG. 3 shows the vanes closed in absence of fluid flow, FIG. 4 shows the vanes closed in the presence of fluid flow, and FIG. 5 shows the vanes open in presence of the fluid flow.

SUMMARY OF THE INVENTION

Briefly stated, the invention is practiced by improvements in the inner tip support of variable inlet guide vanes in an axial flow compressor. An axial flow compressor includes a frame defining an annular path for axial fluid flow and a set of radially extending, circumferentially spaced inlet guide vanes. Each of the guide vanes is rotatably mounted on a spindle at its radially outer end and has radially inner ends subject to deflection and vibration due to aerodynamic forces of the axial fluid flow. A bushing disposed in the frame radially inward of each of said guide vanes, and a button on the end of each of said guide vanes is contained within and forms close clearances with the bushing walls. Normally when the vanes are closed, deflection of the vane inner ends under aerodynamic forces of the fluid on the vane is restrained by the button contacting the bushing walls. The improvement comprises the mounting the button so that it is eccentrically offset with respect to the guide vane spindle by a preselected amount and in a preselected direction to cause the button to provide restraining force on the vane inner ends when the vanes are rotated into an open position.

DESCRIPTION OF THE PREFERRED EMBODIMENT

Figure 1:
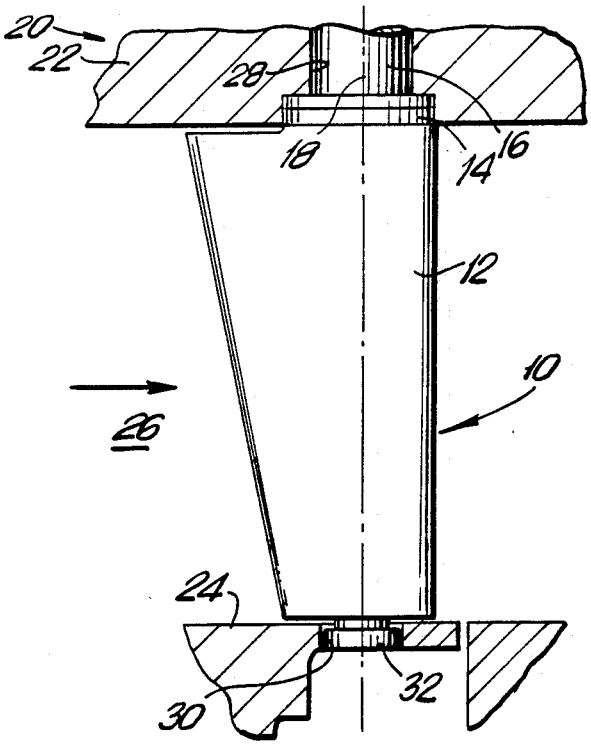
PRIOR ART FIG. 1

Referring now to FIG. 1 of the drawing, a prior art inlet guide vane for an axial flow air compressor used in an industrial gas turbine is shown in elevational view. The construction of the axial flow gas turbine compressor itself is well-known in the art and is omitted from the drawings, but includes a rotor with several stages of radially extending blades interspersed between stages of radially extending circumferentially spaced stationary blades or vanes. Air flowing through an annular passage defined in the frame is compressed as it passes alternately between rotating and stationary stages.

In order to obtain the optimum performance of the air compressor, a first row of stationary blades called inlet guide vanes is constructed so that the angle of the vanes with respect to the fluid flow can be altered. Commonly this is accomplished by mounting each of the vanes on a spindle which is rotatably mounted in the frame. An operating crank on each of the spindles outside of the frame is connected to a ring encircling the frame which is positioned by a servomechanism in response to the dictates of the control system. The vanes may be varied between an "open" position where they provide only slight deflection of the air into the first stage of rotating compressor blades and a "closed" position where they provide maximum deflection of the fluid.

Referring to FIG. 1 showing a prior art inlet guide vane, a variable inlet guide vane assembly is indicated generally at reference number 10. The guide vane assembly comprises an airfoil-shaped vane 12, a platform 14 and a spindle 16 with an axis of rotation 18. The vane 12 is one of a circumferential row of radially extending circumferentially-spaced vanes supported in a gas turbine frame shown generally at 20. Frame 20 includes an outer annular casing 22 and an inner annular casing member 24 defining together between them an annular passage 26 for the axial flow of fluid, in this case air, in the direction shown by the arrow. The outer frame member 22 includes circumferentially-spaced spindle journal bearings 28 which rotatably support the spindles 16 and permit rotation of the vanes 12. Means (not shown) are provided exterior to the frame 20 in known manner to cause the vanes to pivot in unison.

In accordance with a prior art method for suppressing tip vibration, the inner frame member 24 includes a number of circumferentially-spaced inner bushings 30. Each of the vane assemblies 10 includes a cylindrical radially projecting button 32 which is contained within one of the bushings 30 with close clearances. The primary support of the vane is from its outer spindle 16. The radially inner end of each vane is subject to deflection and vibratory excitation from the aerodynamic forces of the turbulent fluid flowing through the annular passage 26. When the vanes deflect, buttons 32 contact the walls of bushings 30 to restrain further movement and suppress vibration. In the prior art construction, the button 32 has been coaxial with spindle 16.

Figure 2:
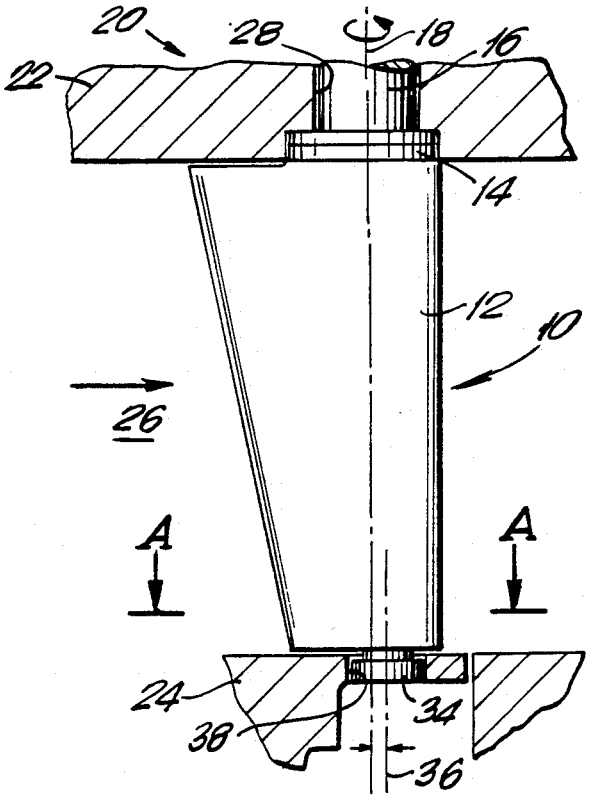

Referring now to the improved construction, FIG. 2 utilizes the same reference numerals as FIG. 1 where elements are the same. In accordance with the present invention, the radially inner portion of the vane is supplied with a cylindrical radially extending button 34 which has a central axis 36. Axis 36 of button 34 is offset in a preselected direction and by a preselected amount designed to minimize and suppress vibration as will be explained. The inner frame member 24 has a number of circumferentially-spaced bushings 38 which contain the respective buttons 34 with close clearances, preferably with a uniform circumferential clearance (see FIG. 3) in the absence of air flow through the compressor.

Figure 3:
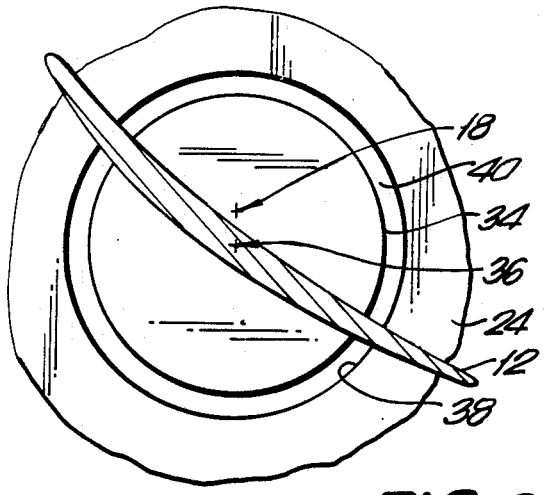
Figure 4:
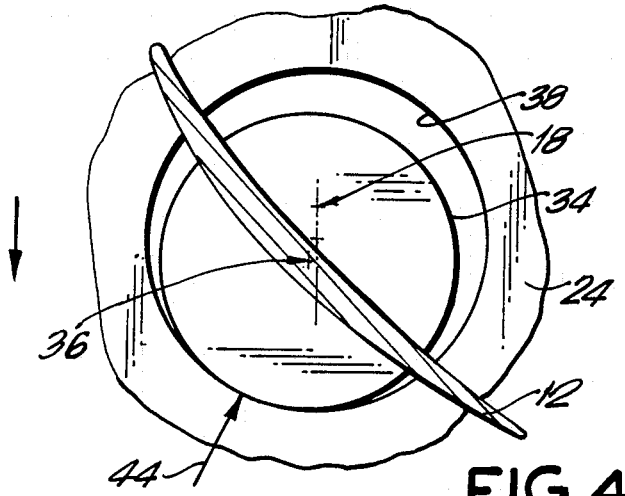
Figure 5:
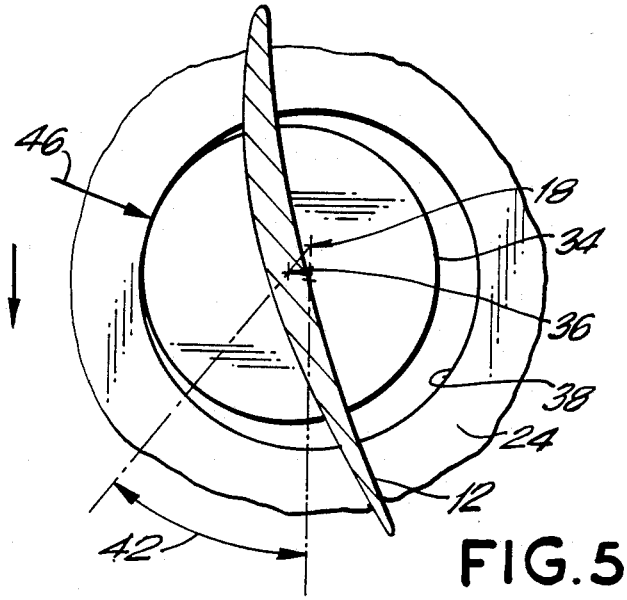

Referring to FIGS. 3, 4, and 5 of the drawing, plan views are shown in order to illustrate the operation under different conditions. The reference numerals correspond to those of FIG. 2, but the respective sizes of the parts are not necessarily to scale, in order to illustrate the operation. The axis of rotation of the inlet guide vane assembly is shown at reference number 18.

Reference to the plan view of the FIG. 3 shows that the axis 36 of button 34 is offset by a pre-selected distance preferably in a range of approximately 0.070 to 0.120 inches (1.78 to 3.05 mm) from the axis 18 of spindle 16. The offset is in a direction toward the bottom of the drawing, i.e., toward the downstream direction of the flow of air through the compressor. FIG. 3 illustrates the position of the button 34 centered within the bushing 38 in the absence of flow, so as to provide a uniform circumferential clearance designated 40, perferably in a range of 0.01 to 0.05 inches (0.25 to 1.25 mm) between button 34 and walls of bushing 38. Vane 12 is shown rotated to a "closed" position.

FIG. 4 of the drawing illustrates the vane 12 in the closed position similar to FIG. 3, but in the presence of air flow through the compressor. In this case, the button 34 is caused by the aerodynamic forces of air on vane 12 in its closed position to deflect approximately to the location indicated by arrow 44 and press there against the wall of bushing 38. This is due to aerodynamic forces on vane 12 in the closed position rather than due to eccentricity of button 34 when the vane is rotated.

Referring to FIG. 5 of the drawing, vane 12 is shown rotated to an "open" position about the axis 18 of spindle 16. The eccentrically offset axis 36 of button 34 is rotated clockwise through a vane rotation angle designated 42. Since button 34 is no longer centered within the bushing, it presses against the wall of bushing 38 at a location denoted by arrow 46. Location 46 is approximately the same as that toward which button 34 would be deflected due to aerodynamic forces of the air on vane 12 when the vane is in the "open" position shown.

OPERATION

The compressor inlet guide vanes are pivoted in unison to selected positions in accordance with the operating requirements of the gas turbine. Rotation about spindles 18 without binding is permitted by the circumferential clearance 40 indicated in FIG. 3.

In the closed vane position at FIG. 4, aerodynamic forces of the fluid deflect vane 12 so that button 34 contacts the bushing wall and suppresses vibration. This caused by the much greater aerodynamic force when the vane is closed.

When vane 12 is open, as illustrated in FIG. 5, the aerodynamic reaction force on the vane toward location 46 is much less, which in some cases with prior art constructions of FIG. 1, was insufficient to deflect the vane such that contacted the bushing. This permitted vibration and the possibility of failure in fatigue. However, in accordance with the present invention, rotation of the vane to the open position causes the eccentrically-offset button 34 to press more tightly against the wall of bushing 38, similar to the condition produced by aerodynamic reaction forces in the vane closed position and thereby suppressing vibration when the vane is in the open position.

While the invention has been illustrated with a cylindrical button in a cylindrical bushing eccentrically-offset in a downstream direction from the vane spindle, alternative constructions are also possible. For example, the vane button need not be circular, the only requirement being that a projection which is eccentrically-offset with respect to the axis of rotation is arranged to cooperate with a portion of the stationary frame. Also, while the invention has been illustrated in the context of inlet guide vanes for an axial flow air compressor, the same principles are applicable to variable position inlet vanes of any shape or orientation in compressors for fluids of all types, where the airfoils experience greater or lesser aerodynamic forces in different orientations.

While there has been described what is considered herein to be the preferred embodiment of the invention, other modifications will occur to those skilled in the art, and it is desired to secure in the appended claims all such modifications as fall within the true spirit and scope of the invention.

What is claimed:

1. In an axial flow compressor having a frame defining an annular path for axial flow of a fluid and a plurality of radially extending, circumferentially-spaced vanes, each of said vanes being rotatably mounted at its radially outer end, said compressor having means for rotating and positioning said vanes in unison about their respective axes of rotation between a first and a second position, each of said vanes having radially inner ends subject to deflection and vibration due to aerodynamic forces of said fluid, the improvement comprising:

a frame portion disposed radially inward of each of said vanes arranged to limit movement of the radially inner end thereof, and a projection on the end of each of said vanes forming clearances with said frame portion, such that deflection of the vane inner ends under aerodynamic forces of the fluid on said vane is restrained by said projection contacting the frame portion, said projection being eccentrically offset with respect to the vane axis of rotation by a preselected amount and in a preselected direction to cause said projection to provide restraining force on the vane inner ends when the vane is rotated from the first position to the second position.

2. The combination according to claim 1, wherein said projection is arranged so that when the vane is rotated to the second position, said projection contacts said frame portion at substantially the same location as that toward which the vane is deflected by said fluid in said second position.

3. The combination according to claim 1 wherein said offset is in the range of 0.70 to 0.120 inches.

4. The combination according to claim 1 wherein said projection is substantially cylindrical and said frame portion includes a substantially cylindrical bushing for receiving said projection.

5. The combination according to claim 4 wherein an annular clearance between said projection and said bushing is provided in the range of 0.01 to 0.05 inches.

6. The combination according to claim 1 wherein said projection is offset from said vane axis of rotation in a downstream direction relative to fluid flow in the compressor.

7. In an axial flow compressor having a frame defining an annular path for axial flow of a fluid and a plurality of radially extending circumferentially-spaced guide vanes, each of said guide vanes having a spindle and being rotatably mounted on said spindle at the vane radially outer end, said compressor having means for rotating and positioning said vanes in unison about the axes of said spindles between an open and a closed position, each of said vanes having radially inner ends subject to deflection and vibration due to aerodynamic forces of said fluid, the improvement comprising:

a bushing disposed in said frame radially inward of each of said vanes, and a button on the end of each of said guide vanes contained within and forming clearances with the bushing walls, whereby deflection of the vane inner ends under aerodynamic forces of the fluid on said guide vane in its closed position is limited by said button contacting the bushing walls, said button being eccentrically offset with respect to the guide vane spindle by a pre-selected amount and in a pre-selected direction to cause the button to provide restraining force on the vane inner ends when the vane is rotated to said open position similar to the restraining force produced by the aerodynamic forces on said guide vane in its closed position.

8. The improvement according to claim 7, wherein said button is a cylindrical radially extending projection formed on the end of said guide vane, and wherein said bushing is a circular hole forming a substantially uniform annular clearance with the button in the absence of fluid flow, said button being offset from the vane axis in a downstream direction on the vane with respect to the fluid flow entering the compressor.

9. The combination according to claim 8, and wherein said annular clearance is in the range of 0.01 to 0.05 inches, and, wherein said offset is in the range of 0.070 to 0.120 inches.

10. In an axial flow compressor having a frame defining an annular path for axial flow of a fluid and a plurality of radially extending, circumferentiallyspaced vanes, each of said vanes being mounted at its radially outer end for rotation about a van axis, each of said vanes having radially inner ends subject to deflection and vibration due to aerodynamic forces of said fluid, the improvement comprising:

a frame portion disposed radially inward of each of said vanes, arranged to limit movement of the radially inner end thereof, and a projection on the end of each of said vanes and receivable in said frame portion with a predetermined clearance, such that deflection of the vane inner ends under aerodynamic forces of the fluid on said vane is restrained by said projection contacting the frame portion, said projection being eccentrically offset with respect to the vane axis of rotation.

11. The combination according to claim 10 wherein said offset is in the range of 0.70 to 0.120 inches.

12. The combination according to claim 10 wherein said projection is substantially cylindrical and said portion includes a substantially cylindrical bushing for receiving said projection.

13. The combination according to claim 12 wherein an annular clearance between said projection and said bushing is provided in the range of 0.01 to 0.05 inches.

14. The combination according to claim 10 wherein said projection is offset from said vane axis of rotation in a downstream direction relative to fluid flow in the compressor.

15. The combination according to claim 14 wherein said offset is in the range of 0.70 to 0.120 inches.

* * * * *